US011309656B2

(12) United States Patent
Winkelmann et al.

(10) Patent No.: US 11,309,656 B2
(45) Date of Patent: Apr. 19, 2022

(54) METHOD FOR ASSEMBLING A PLUG ON A MULTI-CORE SHEATHED CABLE, AND ELECTRICAL PLUG

(71) Applicant: LEONI BORDNETZ-SYSTEME GMBH, Kitzingen (DE)

(72) Inventors: Heinz-Dieter Winkelmann, Wiefeldstede (DE); Dany Becker, Bad Zwischenahn (DE); Tanil Gezgin, Ovelgoenne (DE)

(73) Assignee: LEONI Bordnetz-Systeme GmbH, Kitzingen (DE)

( * ) Notice: Subject to any disclaimer, the term of this patent is extended or adjusted under 35 U.S.C. 154(b) by 70 days.

(21) Appl. No.: 16/611,887

(22) PCT Filed: May 8, 2018

(86) PCT No.: PCT/EP2018/061919

§ 371 (c)(1),
(2) Date: Nov. 8, 2019

(87) PCT Pub. No.: WO2018/206601

PCT Pub. Date: Nov. 15, 2018

(65) Prior Publication Data

US 2021/0143572 A1 May 13, 2021

(30) Foreign Application Priority Data

May 8, 2017 (DE) ..... 10 2017 207 734.4

(51) Int. Cl.
*H01R 13/52* (2006.01)
*H01R 13/436* (2006.01)

(52) U.S. Cl.
CPC ..... *H01R 13/5208* (2013.01); *H01R 13/4367* (2013.01); *H01R 13/521* (2013.01)

(58) Field of Classification Search
CPC ..... H01R 13/5202; H01R 13/5205; H01R 13/5208; H01R 13/5219
(Continued)

(56) References Cited

U.S. PATENT DOCUMENTS 7,156,698 B2 1/2007 Yamashita
9,033,734 B2 * 5/2015 Tanaka ..... H01R 13/6592 439/587
(Continued)

FOREIGN PATENT DOCUMENTS

CN 105144505 A 12/2015
CN 105896153 A 8/2016
(Continued)

*Primary Examiner* — Phuong Chi Thi Nguyen
(74) *Attorney, Agent, or Firm* — Laurence A. Greenberg; Werner H. Stemer; Ralph E. Locher

(57) ABSTRACT

A method assembles a plug on a multi-core sheathed cable which extends in a longitudinal direction and has multiple wires surrounded by a cable sheath. A sealing element made of a sealing material is applied to the multiple wires. The sealing element has individual passages formed through the sealing material for the wires. Subsequently, the wires are assembled in a plug housing, wherein the plug housing has an opening at a rear end thereof, and the sealing element is inserted into the opening and shifted preferably along the wires such that the sealing element sits in the opening in a sealing manner. A sealing coating is then applied, which extends from the rear end of the plug housing to the cable sheath.

18 Claims, 2 Drawing Sheets

(58) Field of Classification Search
USPC ..... 439/275, 587, 588, 733.1, 607.41
See application file for complete search history.

(56) References Cited

U.S. PATENT DOCUMENTS

| | | | | |
|---|---|---|---|---|
| 9,509,074 | B2 | 11/2016 | Otsuta | |
| 9,515,404 | B2 | 12/2016 | Hoefner et al. | |
| 9,887,486 | B2 | 2/2018 | Okamoto | |
| 2005/0042922 | A1* | 2/2005 | Haller ..... | H01R 13/6599<br>439/607.01 |
| 2016/0240957 | A1 | 8/2016 | Ludwig et al. | |

FOREIGN PATENT DOCUMENTS

| | | | |
|---|---|---|---|
| DE | 102005036997 | A1 | 2/2006 |
| EP | 0696827 | A2 | 2/1996 |
| EP | 2525443 | A1 | 11/2012 |
| WO | 2014040699 | A1 | 3/2014 |
| WO | 2016047276 | A1 | 3/2016 |

* cited by examiner

METHOD FOR ASSEMBLING A PLUG ON A MULTI-CORE SHEATHED CABLE, AND ELECTRICAL PLUG

BACKGROUND OF THE INVENTION

Field of the Invention

The invention relates to the fitting of a multi-core, in particular twin-core, sheathed cable to a plug, and also to an electrical plug with a sheathed cable connected to it.

When manufacturing plugs, it is often important to ensure reliable sealing off against the ingress of moisture. To this end, it is necessary for the individual cores to be reliably sealed off.

WO 2014/040699 A1 describes an electrical plug with a sheathed cable connected to it, in which sheathed cable, for sealing-off purposes, a conical sealing element which consists of two half-shells is provided as an insert part which is arranged between the cores of the sheathed cable and a receptacle of a plug housing. Reliable sealing off is carried out by subsequent encapsulation by injection molding.

Proceeding from the above, the invention is based on the object of rendering possible fitting of a plug with a sheathed cable connected therein in an extremely simple manner and, at the same time, ensuring a good sealing action.

SUMMARY OF THE INVENTION

According to the invention, the object is achieved by a method for fitting a plug having the features of the independent method claim.

Preferred developments are contained in the dependent claims.

The invention is further achieved by an electrical plug with a multi-core sheathed cable, which is connected thereto, as claimed in the independent plug claim.

The advantages and preferred refinements mentioned in respect of the method can be transferred mutatis mutandis to the electrical plug, and vice versa.

The plug is arranged on a multi-core sheathed cable which extends in a longitudinal direction and has a plurality of cores which are surrounded by a cable sheath.

The process for fitting the plug is such that the sealing element which is composed of a sealing material is first applied to, in particular pushed onto, the cores. To this end, the sealing element has an individual bushing through the sealing element for each core.

The sheathed cable which is prepared in this way and has the arranged sealing element is then inserted into a plug housing of the plug from the rear and fitted in said plug housing. Here, the sealing element is inserted into a rear-side receptacle of the plug housing until the sealing element is situated in the receptacle, in particular in a sealing manner. To this end, the sealing element is preferably moved along the cores into the receptacle. A sealing-off sheathing which extends from the rear-side end of the plug housing to the cable sheath is further applied thereafter.

In the solution according to the invention, it is particularly important to design the sealing element as an integral, that is to say monolithic, part which is situated in the receptacle of the plug housing in a sealing manner. Simple and cost-effective manufacture of the sealing element is achieved owing to the integral design of the sealing element. Furthermore, an improved sealing action than, for example, in comparison to a multi-core sealing element is achieved owing to the integral design of the sealing element.

According to a preferred refinement, the sealing element is first applied to the plurality of cores and then—preferably after the sealing element is applied—a contact element is attached, preferably clamped, to the end side of a respective core. The cores are fitted in the plug housing of the plug by way of the contact elements. Automated methods are preferably used for this purpose, in particular for applying the sealing element to the cores, which automated methods provide advantages in respect of the fitting sequence. The fitting can take place more easily and more quickly.

The sheathing is preferably in particular applied by a casting or injection-molding process. To this end, known casting or injection-molding processes which further simplify and speed up the fitting process are used for example.

In this case, that is to say when applying the sheathing by injection molding or casting, a press-in force which is directed in the longitudinal direction is expediently exerted, so that the sealing element is pressed into the receptacle by the press-in force. As a result, a sealing behavior of the sealing element can advantageously be influenced by the injection force. That is to say, the greater the press-in force, the more strongly the sealing element is pressed into the receptacle and the better the sealing behavior. Here, sealing behavior is understood to mean a sealing-off action of the sealing element, for example a longitudinal water-tightness.

The sealing element is expediently designed in the form of a conical element, that is to say tapers in the longitudinal direction. As a result, the sealing action firstly between the sealing element and the wall of the receptacle and secondly between the sealing element and the individual cores is improved by the injection-molding process and the associated press-in force, and therefore reliable sealing off is ensured. In addition, a simple geometry of the sealing element which renders possible simple manufacture is formed by the conical shape.

The special conical shape is particularly important in respect of the reliable sealing action. The sealing element has, in general, an encircling lateral surface, wherein said lateral surface encloses an acute angle in relation to the longitudinal direction in an encircling manner. Said acute angle lies, for example, in the range of from 5°-35°, and preferably in the range of from 10°-20°. The entire lateral surface of the sealing element is preferably designed in a smooth manner and, in particular, without encircling ribs or grooves.

The sealing element is, in general, a prefabricated integral component which—apart from the bushings for the individual cores—does not have any further openings or slots or the like.

Furthermore, the sealing element is preferably formed from a softer material than the plug housing. In other words, the sealing element has a lower hardness than the plug housing. The sealing element contains, for example, a thermoplastic polyurethane material (TPU material) or is manufactured, in particular, from a material of this kind. This has the advantage that the sealing element is inserted into the plug housing in an interlocking manner owing to the press-in force and therefore increases the sealing action.

In particular, considerably simplified fitting is achieved owing to the configuration of the sealing element as an integral component. No complex handling of two half-shells is required. Rather, it is possible to simply push the sealing element onto the cores. This is expediently done in an automated manner. Moving the sealing element into the receptacle along the cores also preferably takes place in an automated manner, for example with the aid of an auxiliary tool.

Overall, automated fitting of the plug is rendered possible as a result.

The sealing action of the sealing element firstly in relation to the wall of the receptacle of the plug housing and secondly in relation to the individual cores is preferably furthermore influenced and set by the choice of injection pressure during injection molding.

The sheathed cable is preferably a twin-core sheathed cable with two cores.

BRIEF DESCRIPTION OF THE SEVERAL VIEWS OF THE DRAWING

A variant embodiment will be explained in more detail below with reference to the figures in which, in partially simplified illustrations.

DESCRIPTION OF THE INVENTION

Figure 1:
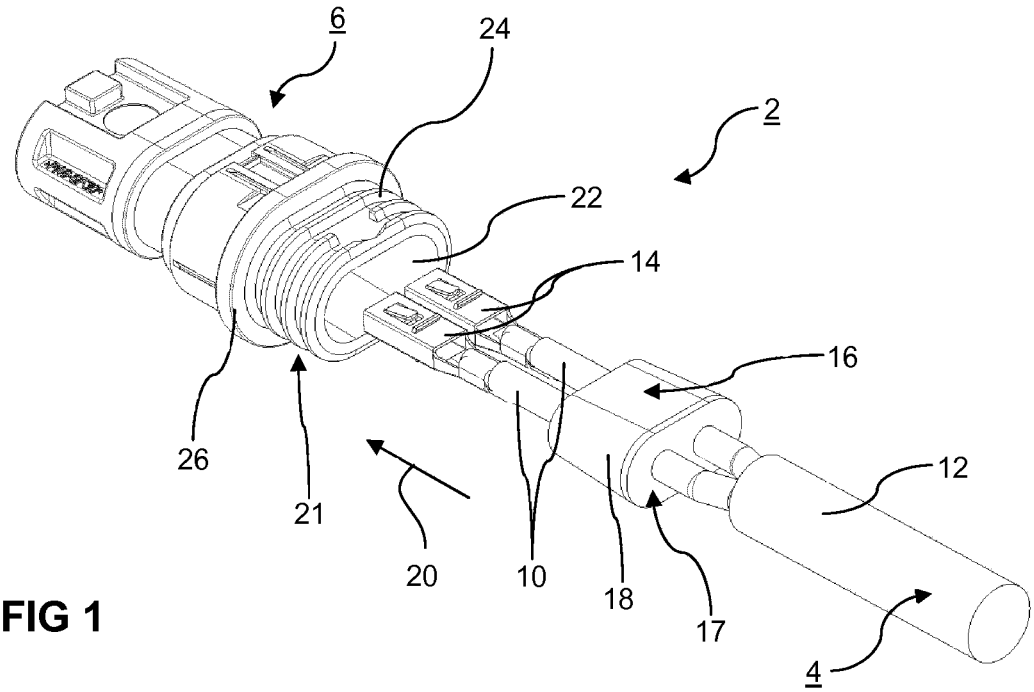
FIG. 1: shows a perspective illustration of a sheathed cable with an attached sealing element and also attached contact elements before it is fitted into a plug housing.

FIG. 1 illustrates a perspective exploded illustration of a prefabricated plug 2 which is fitted to a sheathed cable 4.

In the exemplary embodiment, the sheathed cable 4 is designed as a twin-core sheathed cable with two cores 10 which are surrounded by a cable sheath 12. The cores 10 are each stripped of insulation at their front end (that is to say the end by way of which they are arranged in the plug 2). A contact element 14 is attached to the area of the cores 10 which is stripped of insulation. A sealing element 16 which consists of a soft, elastic plastic material, in particular TPU, is pushed onto the two cores 10. The sealing element 16 is designed as a conical element, that is to say has a lateral surface 18 which tapers with respect to a longitudinal direction 20 at an acute angle in relation to this longitudinal direction 20. In order to push the sealing element 16 onto the cores 10, the sealing element 16 has an individual bushing 17 for the cores 10.

In the exemplary embodiment, the sealing element 16 has an at least approximately oval base area. To this end, the base area has two opposite straight sections which are connected to one another in each case by means of a (circular) arc. As an alternative to this, the base area can also be circular. The lateral surface 18 is therefore designed, in particular, in the manner of a lateral surface of a cone.

In addition, the plug 2 has a plug housing 6. The plug housing 6 is preferably a plastic housing and has a receptacle 22, which is designed for receiving the sealing element 16, on its rear-side end which is directed toward the sheathed cable 4. In particular, this receptacle 22 preferably likewise has a conical configuration which complements the sealing element 16.

As can further be seen with reference to FIG. 1, the plug housing 6 has fins 24 or ribs on its outer wall 21 in the region of the receptacle 22.

The fins 24 are of encircling design, wherein a central fin 24 is interrupted in the exemplary embodiment. An interlocking connection to a sheathing 8 (cf. FIG. 3) is formed by the fins 24, which interlocking connection is active in and against the longitudinal direction 20. In addition, an interlocking connection which is active in the circumferential direction is also formed by the interruption in the central fin 24.

As viewed in the longitudinal direction 20 toward the front end, the fins 24 are delimited by an encircling collar 26. A sheathing 8 which is applied by injection molding or casting and extends as far as the cable sheath 12 of the sheathed cable and therefore ensures reliable and secure sealing off is applied to said rear-side region with the encircling fins 24 as far as the collar 26—as can be seen with reference to FIG. 3.

Figure 2:
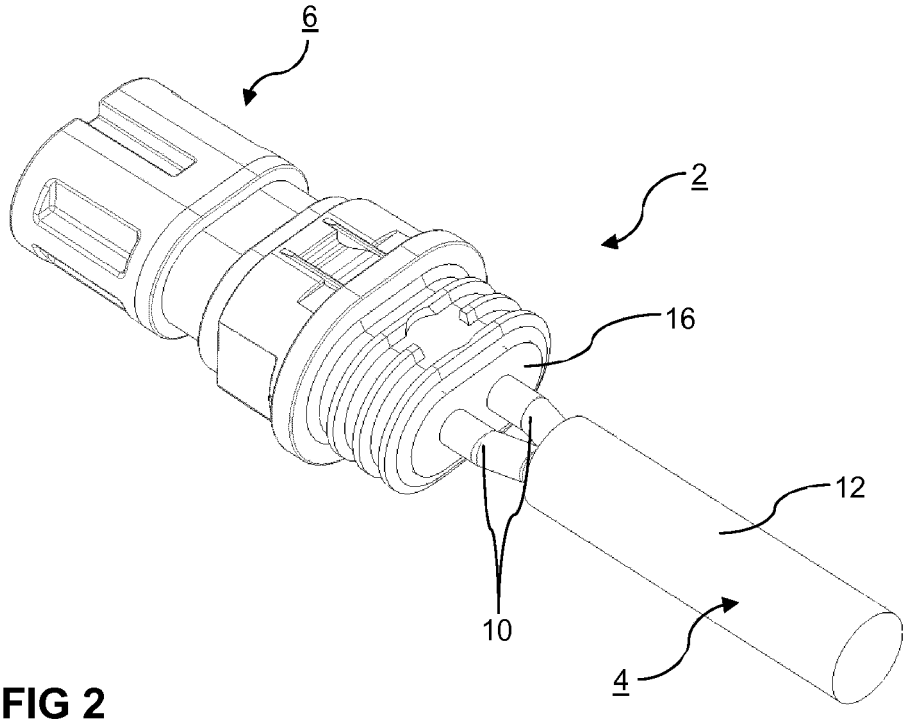
FIG. 2: shows the components illustrated in FIG. 1 after the contact elements and the sealing element have been pushed into the plug housing.

FIG. 2 shows the plug 2 in an intermediate state of manufacture. Here, the cores 10 which are provided with the contact elements 14 have been inserted into the plug housing 6. The sealing element 16 which is pushed onto the cores 10 is arranged, preferably in an interlocking manner, in the receptacle 22 of the plug housing 6 here.

Figure 3:
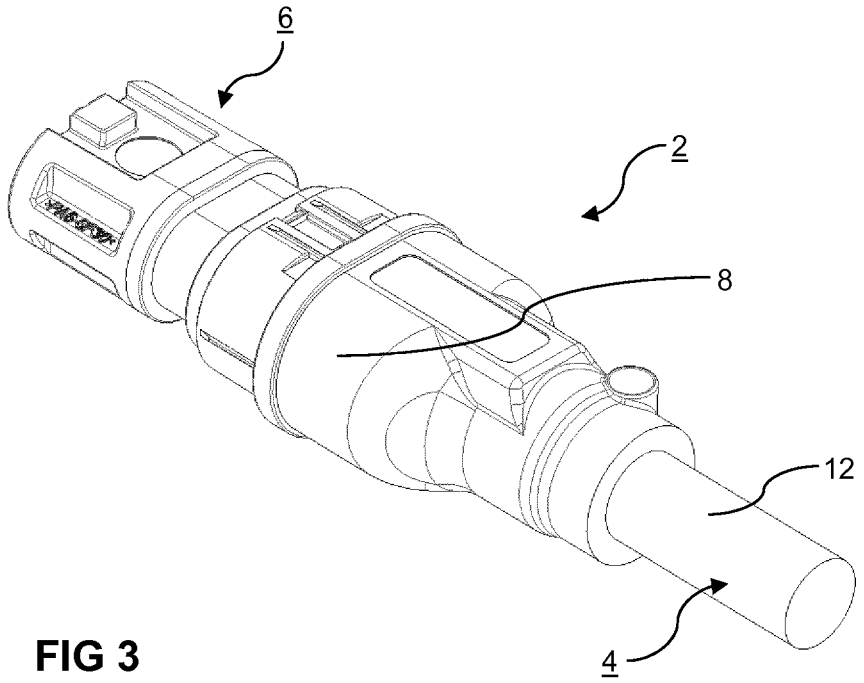
FIG. 3: shows the finished plug with a fitted sheathed cable having a sheathing which is applied by injection molding.

FIG. 3 illustrates the completed plug 2 with the sheathed cable 4 fitted. In this case, the plug 2 has the plug housing 6 and a sheathing 8 which is applied by injection molding and encloses the region in which the sheathed cable 4 is inserted into the plug housing 6. The sheathing 8 extends as far as the collar 26 and bears against said collar at the end side. Said sheathing is applied by casting or injection molding and is of solid design. The sealing element 16 is pushed into the receptacle 22 in the longitudinal direction 20 by the pressure which is produced during the application, and therefore the sealing action is improved.

The invention is not restricted to the exemplary embodiment described above. Rather, other variants of the invention can also be derived therefrom by a person skilled in the art, without departing from the subject matter of the invention. In particular, all of the individual features described in connection with the exemplary embodiment can furthermore also be combined with one another in a different way, without departing from the subject matter of the invention.

LIST OF REFERENCE SYMBOLS

2 Plug
4 Sheathed cable
6 Plug housing
8 Sheathing
10 Core
12 Cable sheath
14 Contact element
16 Sealing element
18 Lateral surface
20 Longitudinal direction
21 Outer wall
22 Receptacle
24 Fins
26 Collar

The invention claimed is:

1. A method for fitting a plug to a multi-core sheathed cable extending in a longitudinal direction and the multi-core sheathed cable having a plurality of cores which are surrounded by a cable sheath, which comprises the steps of:

applying a sealing element composed of a sealing material to the plurality of cores, wherein the sealing element has an individual bushing through the sealing material for each of the cores;

subsequently fitting the cores into a plug housing, wherein the plug housing has a receptacle formed therein on a rear-side end and the sealing element is pushed into the receptacle and, to this end, is moved along the cores, so that the sealing element is situated in the receptacle in a sealing manner; and applying a sealing-off sheathing extending from the rear-side end of the plug housing to the cable sheath.

2. The method according to claim 1, which further comprises first applying the sealing element to the plurality of cores and then a contact element is attached to an end side of each of the cores.

3. The method according to claim 1, wherein the sealing element is a prefabricated component which is pushed onto the cores.

4. The method according to claim 1, which further comprises forming the sealing element to be softer than the plug housing.

5. The method according to claim 1, wherein the sealing element is a solid and integral component, the component has a lateral surface that is smooth and free of ribs or grooves, the sealing element is a prefabricated component pushed onto the cores, attaching a contact element to the end side of a respective core, subsequently fitting the cores are fitted into the plug housing, the sealing element tapers conically in the longitudinal direction, the receptacle has a conical configuration which complements the sealing element, the sealing element is softer than the plug housing, the sealing element is manufactured from a thermoplastic polyurethane material, applying the sealing-off sheathing by injection molding for exerting a press-in force directed in the longitudinal direction on the sealing element and pressing the sealing element into the receptacle.

6. The method according to claim 1, which further comprises applying the sealing-off sheathing by injection molding.

7. The method according to claim 6, wherein when the sealing-off sheathing is applied by the injection molding, exerting a press-in force which is directed in the longitudinal direction on the sealing element, so that the sealing element is pressed into the receptacle.

8. The method according to claim 1, which further comprises tapering the sealing element in the longitudinal direction.

9. The method according to claim 8, wherein the sealing element tapers conically in the longitudinal direction.

10. An electrical plug, comprising:

a multi-core sheathed cable extending in a longitudinal direction and having a plurality of cores surrounded by a cable sheath;

a plug housing having a rear-side end with a receptacle formed therein, said cores being inserted into said plug housing through said receptacle;

contact elements each having an end side fitted to one of said cores and disposed in said plug housing;

a sealing-off sheathing extending from said rear-side end of said plug housing to said cable sheath; and an integral sealing element composed of a sealing material is disposed in said receptacle, wherein said cores are individually guided through said sealing material.

11. The plug according to claim 10, wherein said sealing element is a solid and integral component, said component has a lateral surface that is smooth and free of ribs or grooves.

12. The plug according to claim 10, wherein said sealing-off sheathing is configured as a cast or injection-molded component and rests on said sealing element and exerts a force component on said sealing element in the longitudinal direction.

13. The plug according to claim 10, wherein said multi-core sheathed cable is a twin-core sheathed cable with two of said cores.

14. The plug according to claim 10, wherein said sealing element is a solid and integral component, the component has a lateral surface that is smooth and free of ribs or grooves;

said sealing element tapers conically in the longitudinal direction;

said receptacle has a conical configuration which complements the sealing element;

said sealing element is softer than said plug housing;

said sealing element is manufactured from a thermoplastic polyurethane material;

said sealing-off sheathing is configured as a cast or injection-molded component and rests on said sealing element and exerts a force component on said sealing element in the longitudinal direction.

15. The plug according to claim 10, wherein said sealing element tapers in the longitudinal direction.

16. The plug according to claim 15, wherein said sealing element tapers conically in the longitudinal direction.

17. The plug according to claim 10, wherein said sealing element has a lateral surface which is oriented so as to run in an encircling manner at an acute angle in relation to the longitudinal direction.

18. The plug according to claim 17, wherein said lateral surface of said sealing element is configured entirely in a smooth manner and without encircling ribs or grooves.

* * * * *